US007040676B1

(12) United States Patent
Melfi

(10) Patent No.: US 7,040,676 B1
(45) Date of Patent: May 9, 2006

(54) STRIKE PLATE CHAMBER FOR A DEAD BOLT

(76) Inventor: Kevin C Melfi, 922 Jewett Ave., Staten Island, NY (US) 10314

( * ) Notice: Subject to any disclaimer, the term of this patent is extended or adjusted under 35 U.S.C. 154(b) by 0 days.

(21) Appl. No.: 10/852,721

(22) Filed: May 24, 2004

(51) Int. Cl.
*E05B 15/02* (2006.01)

(52) U.S. Cl. ..... 292/340; 292/341

(58) Field of Classification Search ..... 292/340, 292/341, 341.14, 57–61
See application file for complete search history.

(56) References Cited

U.S. PATENT DOCUMENTS

| | | | | |
|---|---|---|---|---|
| 1,182,229 | A | 5/1916 | Thomas | |
| 1,806,978 | A * | 5/1931 | Kilberg | 292/202 |
| 1,823,104 | A * | 9/1931 | Johnson | 292/87 |
| 4,770,452 | A | 9/1988 | Petree, Jr. | |
| 4,802,701 | A | 2/1989 | Mazie | |
| 4,865,370 | A | 9/1989 | Francis | |
| 5,024,475 | A | 6/1991 | Francis | |
| 5,088,780 | A | 2/1992 | Doherty | |
| 5,241,790 | A | 9/1993 | Schimpf | |
| 5,588,314 | A * | 12/1996 | Knezovich | 70/56 |
| 6,178,700 | B1 | 1/2001 | Mayer, Jr. | |
| 6,418,669 | B1 | 7/2002 | Suter | |
| 6,679,533 | B1 * | 1/2004 | Bruner et al. | 292/346 |
| 2003/0057718 | A1 | 3/2003 | Stoehr | |

FOREIGN PATENT DOCUMENTS

| | | |
|---|---|---|
| CA | 2.104.133 | 2/1995 |
| WO | WO03/062572 | 7/2003 |

* cited by examiner

*Primary Examiner*—Gary Estremsky
(74) *Attorney, Agent, or Firm*—Micahel I. Kroll

(57) ABSTRACT

The present invention 10 discloses a dead bolt reinforcement plate comprised of a housing having a chamber 14 for receiving and encompassing the bolt of a dead bolt lock when the bolt is in the extended position having plates 12 extending therefrom with a plurality of apertures 16 therein for the insertion therein of fasteners 26. The pipe chamber 14 may be welded at 28 to the plates 12.

9 Claims, 6 Drawing Sheets

STRIKE PLATE CHAMBER FOR A DEAD BOLT

BACKGROUND OF THE INVENTION

1. Field of the Invention

The present invention relates generally to locks and, more specifically, to a dead bolt reinforcement plate comprised of a housing having a chamber for receiving and encompassing the bolt of a dead bolt lock when in the extended position having plates extending therefrom with a plurality of apertures for the insertion therein of fasteners.

2. Description of the Prior Art

There are other strike plates designed for locks. Typical of these is U.S. Pat. No. 1,182,229 issued to Thomas on May 9, 1916.

Another patent was issued to Petree, Jr. on Sep. 13, 1988 as U.S. Pat. No. 4,770,452. Yet another U.S. Pat. No. 4,802,701 was issued to Mazie on Feb. 7, 1989 and still yet another was issued on Sep. 12, 1989 to Francis as U.S. Pat. No. 4,865,370.

Another patent was issued to Francis on Jun. 18, 1991 as U.S. Pat. No. 5,024,475. Yet another U.S. Pat. No. 5,088,780 was issued to Doherty on Feb. 18, 1992. Another was issued to Schimpf on Sep. 7, 1993 as U.S. Pat. No. 5,241,790 and still yet another was issued on Jan. 30, 2001 to Mayer, Jr, as U.S. Pat. No. 6,178,700.

Another patent was issued to Suter on Jul. 16, 2002 as U.S. Pat. No. 6,418,669. Yet another U.S. Patent Application Publication No. 2003/0057718 was filed by Stoehr on Mar. 27, 2003. Another was issued to Vigneault, et al. on Feb. 14, 1995 as Canadian Patent No. 2,104,033 and still yet another was published on Jul. 31, 2003 by Vito as WIPO Publication No. WO 03/62572.

U.S. Pat. No. 1,182,229

Inventor: William N. Thomas

Issued: May 9, 1916

A strike for locks, comprising a plate having a plurality of bolt openings and a laterally projecting latch bolt lip associated with one of said openings, a box portion formed and adapted for location back of one of said openings, and means for securing said box portion at either face of said plate; substantially as described.

U.S. Pat. No. 4,770,452

Inventor: Robert W. Petree, Jr.

Issued: Sep. 13, 1988

A security device provided for use in a door frame assembly has a door jamb disposed in surrounding relation to a door. The security device is comprised of an elongated, rigid plate inserted into a slot and firmly anchored in place in the door jamb in spaced parallel relation to the free vertical edge of the door. The plate has an opening aligned with an opening in the door jamb, and the spacing between the plate and face of the door jamb is such that a deadbolt on the door will project through the aligned openings in the door jamb and plate.

U.S. Pat. No. 4,802,701

Inventor: George S. Mazie

Issued: Feb. 7, 1989

An improved latch plate in combination with an anchor base plate designed to resist forceable entry when disposed within a doorjamb. The construction of said latch may be adapted to engage either a sliding bolt or dead bolt when disposed over the bolt recess of a doorjamb. The latch has a flat plate portion with a large opening to receive a bolt, the flat plate has anchor corner and lip end, with an anchor stem extending inwardly towards the doorjamb and perpendicularly from the inside of the flat plate at the anchor corner. The anchor stem is in bearing contact within the doorjamb recess of the door frame and protrudes through a longitudinal aperture located in the anchor base plate into the doorjamb frame. The anchor base has a plurality of apertures disposed on both sides of the longitudinal aperture and are so located to cooperately receive the screws from the latch plate. The location of the plurality of apertures disposed on the anchor base plate is such so as not to cause a splitting of the wood frame into which they are screwed due to their offset. Traverse to the plurality of screws of the anchor base plate are a pair of safety screws disposed into the doorjamb through apertures located in anchor stem of the latch plate. Both the anchor stem of the lock strike plate and anchor base plate are concealed from view when mounted on the doorjamb. A tab extends into the doorjamb framing from the large opening disposed on the flat portion of the latch to further increase the strength of the assembly against unauthorized or foreceable entry by means of kicking and/or pushing against the door. Thus providing the occupant of a dwelling with improved security as compared with conventional lock strike plates.

U.S. Pat. No. 4,865,370

Inventor: Charles E. Francis

Issued: Sep. 12, 1989

A strengthening device for use with a deadbolt lock and includes a planar metal anchor plate having a hole with an anchor pocket welded to the plate at the hole. The anchor plate is installed between the door jamb and the framing or door stud. The anchor pocket extends into the hole in the door jamb through which the deadbolt is insertible. When the deadbolt is installed in the door, the bolt will extend into the anchor plate. In another embodiment, a metal bolt guide is inserted from the outer side of the door jamb into the anchor pocket.

U.S. Pat. No. 5,024,475

Inventor: Charles E. Francis

Issued: Jun. 18, 1991

A strengthening device for use with a deadbolt lock and includes a planar metal anchor plate having a hole with an anchor pocket welded to the plate at the hole. The anchor plate is installed between the door jamb and the framing or door stud. The anchor pocket extends into the hole in the door jamb through which the deadbolt is insertible. When the deadbolt is installed in the door, the bolt will extend into the anchor plate. In another embodiment, a metal bolt guide is inserted from the outer side of the door jamb into the anchor pocket.

U.S. Pat. No. 5,088,780

Inventor: William Doherty

Issued: Feb. 18, 1992

A lock-keeper security shield plate assembly arranged over the usual lock-keeper plate which is in a routed recess of the wooden door jamb lock rail. The reinforcing shield plate is zig-zag shaped having an upset center section and two integrally formed angle face plates, shaped for one said shape to fit all width door frames with door stop rails that also vary in face width. One said face plate defines a bolt opening that is to be aligned with a bolt aperture of an underlying lock-keeper plate of a dead bolt mechanism, the other face plate defines a screw aperture in a key location in relation to a tubular dead bolt lock cylinder assembly mounted on a said door that virtually prevents tampering with the elongated anchor screw driven through said screw hole, through face of stop rail of wood jamb and framing studs there behind, said location of anchor screw in space relation to said lock cylinder rim prevents the removal of said anchor screw (door closed). Other means to protect said screw are shown in several modified drawings.

U.S. Pat. No. 5,241,790

Inventor: George A. Schimpf

Issued: Sep. 7, 1993

A reinforcing plate for reinforcing a doorjamb to prevent break-ins and particularly kick-ins of the door by unauthorized persons is mounted in back of the doorjamb in the space between the jamb and the door frame. In order to install the reinforcing plate behind the doorjamb, the interior trim strip is removed from the door frame and the reinforcing plate is mounted behind the doorjamb, preferably by the use of shims to temporarily jam the plate between the doorjamb and the door frame. While the reinforcing plate is temporarily secured by a wedging means against the back of the door frame, holes are drilled in the door frame and through the reinforcing plate using appropriately-sized drill bits. Self-tapping threaded screws are then passed through the doorjamb and screwed tightly into the reinforcing plate the attach the plate to the doorjamb and reinforce the jamb. As an alternative, special fastenings are provided to fasten the striker plate to the reinforcing plate.

U.S. Pat. No. 6,178,700

Inventor: Frederic C. Mayer, Jr.

Issued: Jan. 30, 2001

An apparatus for reinforcing a door frame, comprising a pair of elongated metal plates extending substantially the length and width of the jambs forming either side of the door frame is disclosed. Each of the metal plates defines a plurality of attachment holes for attaching the plates individually to the back sides of each of the jambs with fasteners passing therethrough. In addition, each plate defines a plurality of installation holes for allowing the door frame to be secured in the framed opening with fasteners passing through the jambs, the installation holes, and into adjacent members of the framed opening. Each plate further defines a plurality of openings along the lengths thereof, which allows attachment of appropriate hinges or strike plate to the front side of the corresponding jamb by fasteners passing through the hinge or strike plate, the jamb, the openings, and into an adjacent member of the framed opening.

U.S. Pat. No. 6,418,669

Inventor: Paul J. Suter

Issued: Jul. 16, 2002

A structure for reinforcing doorjambs wherein first and second reinforcement plates are located between the doorjamb and the structure frame. Reinforcement plates are arranged in overlapping fashion and are provided with respective bolt holes that are in registry with a bolt hole of the doorjamb The overlapped reinforcement plate structure provides increased strength and greater flexibility for ease of installation.

U.S. Patent Application Publication No. 2003/0057718

Inventor: Flek G. Stoehr

Published: Mar. 27, 2003

A new and/or retrofitable striker plate with normal surfaces to accommodate fastening apertures, which are remote from the door jamb bolt opening and aligned with the jamb and jamb receiving support frame, respectively.

Canadian Patent Number 2,104,033

Inventor: Remi Vigneault, et al.

Issued: Feb. 14, 1995

A door frame reinforcing plate used for reinforcing used for reinforcing a door frame adjacent a lock striker is disclosed. The reinforcing plate is comprised of a first plate section adapted to be secured over an interior flat surface of the frame adjacent the lock striker. The flat plate section has a lock bolt opening therein adjacent a first end of the plate section where the plate is bent at right angle to form a flange to overlie an edge surface portion of the door frame. A plurality of holes a re provided in the plate above and below the opening for receiving connecting screws which secure the lock striker. A further series of holes is provided in the plate section to receive fasteners which are secured to the frame from an exterior surface of the frame. The reinforcing plate is not visible from outside the door frame and behind the usual frame moldings.

W.I.P.O. Publication Number WO 03/062572

Inventor: Robert A. Vito

Published: Jul. 31, 2003

A hasp enclosure for protecting an eye of a hasp and receiving a lock. The hasp enclosure includes a cover having an opening which extends into an interior eye receiving chamber. An aperture is defined through the cover which intersects the interior eye chamber in a location which is aligned with the eye so that the lock can be inserted through the aperture in the cover and eye. The cover may be a separate piece or may be connected to the hasp face plate over the hasp eye receiving slot.

While these strike plated may be suitable for the purposes for which they were designed, they would not be as suitable for the purposes of the present invention, as hereinafter described.

SUMMARY OF THE PRESENT INVENTION

The present invention discloses a dead bolt reinforcement plate comprised of a housing having a chamber for receiving and encompassing the bolt of a dead bolt lock when the bolt is in the extended position having plates extending therefrom with a plurality of apertures therein for the insertion therein of fasteners. The pipe chamber may be welded to the plates.

The present invention provides a receptacle for a dead bolt lock comprised of a housing having a chamber with a throughbore for receiving the bolt in its locked position. The housing further comprises planar plates positioned on each side of the chamber forming an integral part therewith and extending longitudinally between the chamber distal ends and depending therefrom with a plurality of apertures within said plates whereby said dead bolt receiver is selective fastened to the door frame providing a dead bolt locking element that is not currently available.

A primary object of the present invention is to provide a reinforced strike plate housing for a dead bolt.

Another object of the present invention is to provide a reinforced strike plate housing having a chamber for receiving a dead bolt.

Yet another object of the present invention is to provide a reinforced strike plate housing wherein said chamber encompasses the bolt when in the extended locked position.

Still yet another object of the present invention is to provide a reinforced strike plate housing having plates extending from said bolt chamber.

Another object of the present invention is to provide a reinforced housing strike plate housing wherein said plates have a plurality of apertures for the insertion of fasteners.

Yet another object of the present invention is to provide a reinforced strike plate housing that is mounted opposing a dead bolt lock having a chamber for receiving and sheathing the bolt therein.

Still yet another object of the present invention is to provide a reinforced strike plate housing that is mounted to the door frame structural members.

Additional objects of the present invention will appear as the description proceeds.

The present invention overcomes the shortcomings of the prior art by providing a dead bolt reinforcement plate comprised of a housing having a chamber for receiving and encompassing the bolt of a dead bolt lock when in the extended position having plates extending therefrom with a plurality of apertures for the insertion therein of fasteners.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
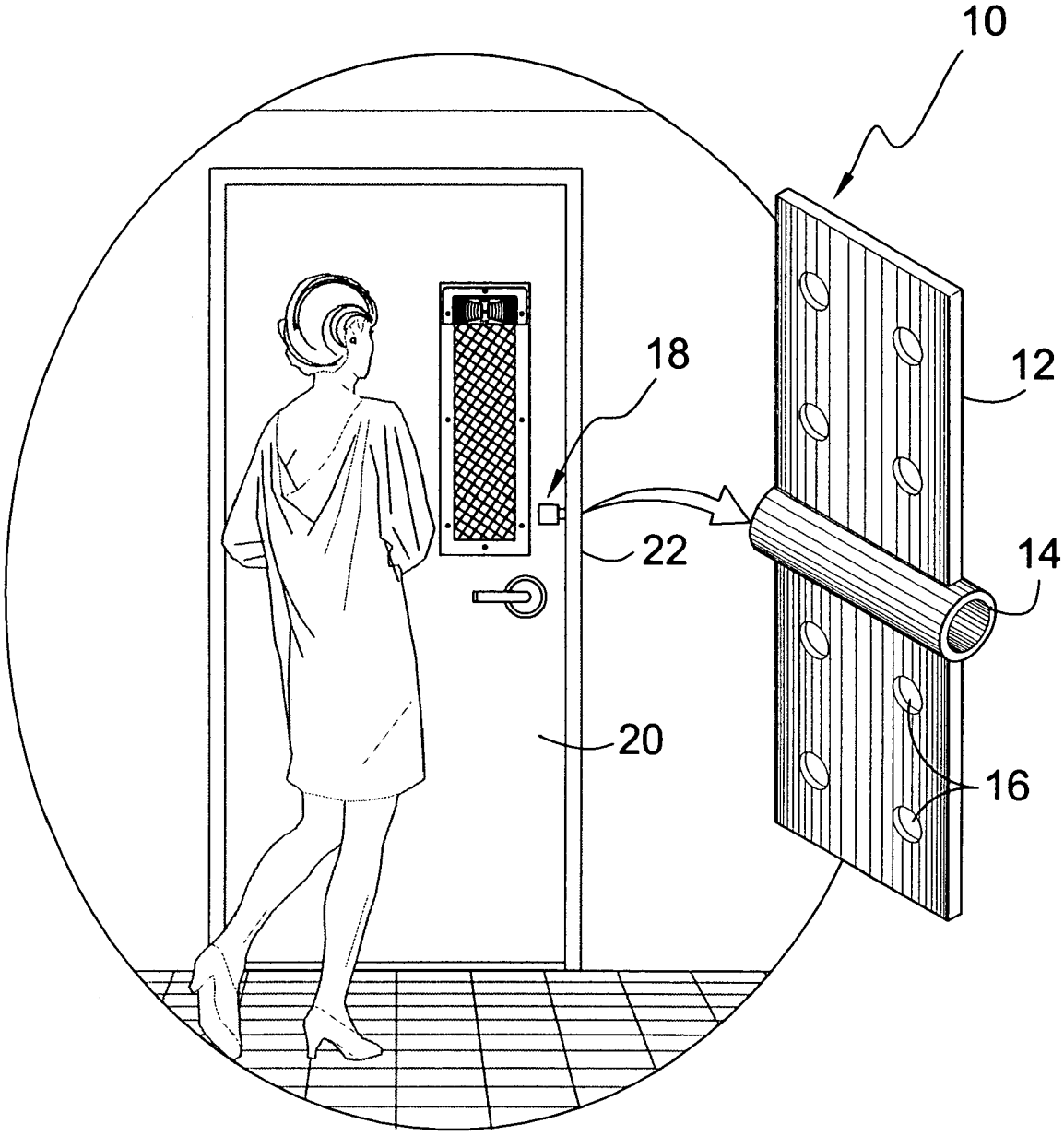
FIG. 1 is an illustrative view of the present invention in use.

With regard to reference numerals used, the following numbering is used throughout the drawings.

10 present invention
12 plate
14 pipe
16 apertures
18 dead bolt
20 door
22 frame
24 lumber
26 bolt and washer
28 weld

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 comprises a pair of dead bolt plates 12 having a receiver pipe or chamber 14 that is welded between the two steel plates having multiple mounting apertures 16. The device 10 transfers any force applied to a door's dead bolt 18 to the rough frame 22 of the door 20 through the receiver chamber 14 and plates 12 which are bolted to the door's rough opening frame. The device 10 may also be mounted to the door jamb.

Figure 2:
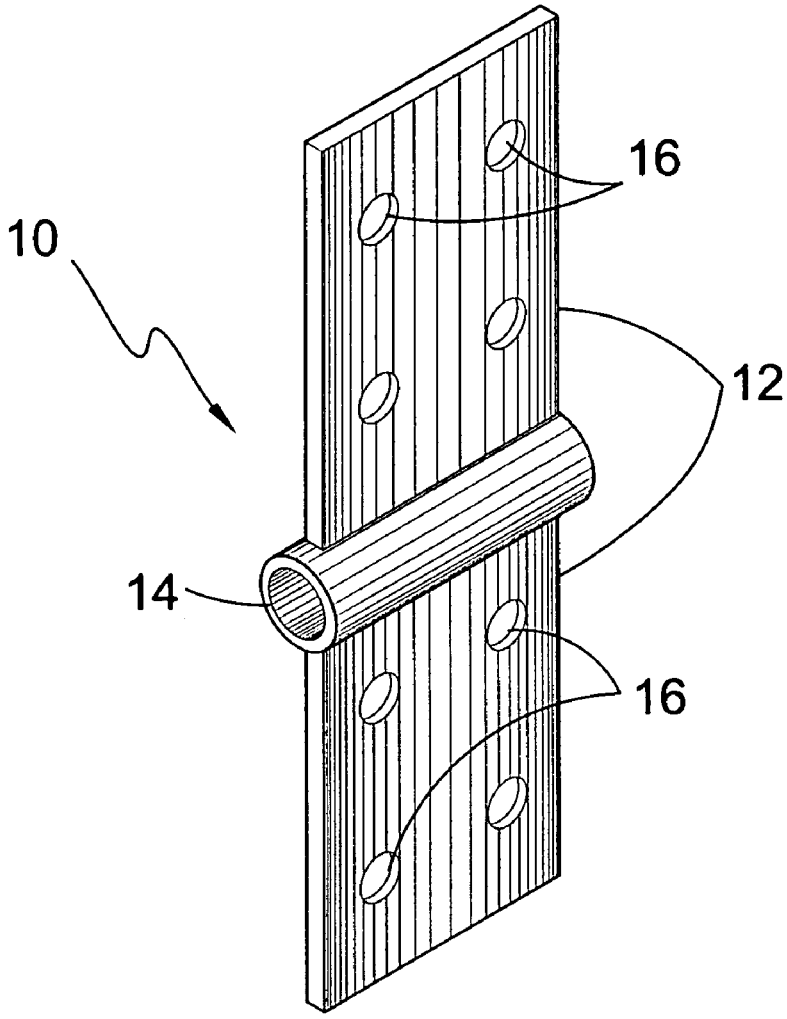
FIG. 2 is a perspective view of the present invention.

Turning to FIG. 2, shown therein is a perspective view of the present invention 10. Shown is a perspective view of the present invention 10 being a dead bolt plate which comprises a receiver pipe 14 that is welded to steel plates 12 having mounting apertures 16 therein. The device 10 transfers any force applied to a door's dead bolt to the rough frame of the door through the receiver chamber 14 which is bolted to the door's rough opening frame.

Figure 3:
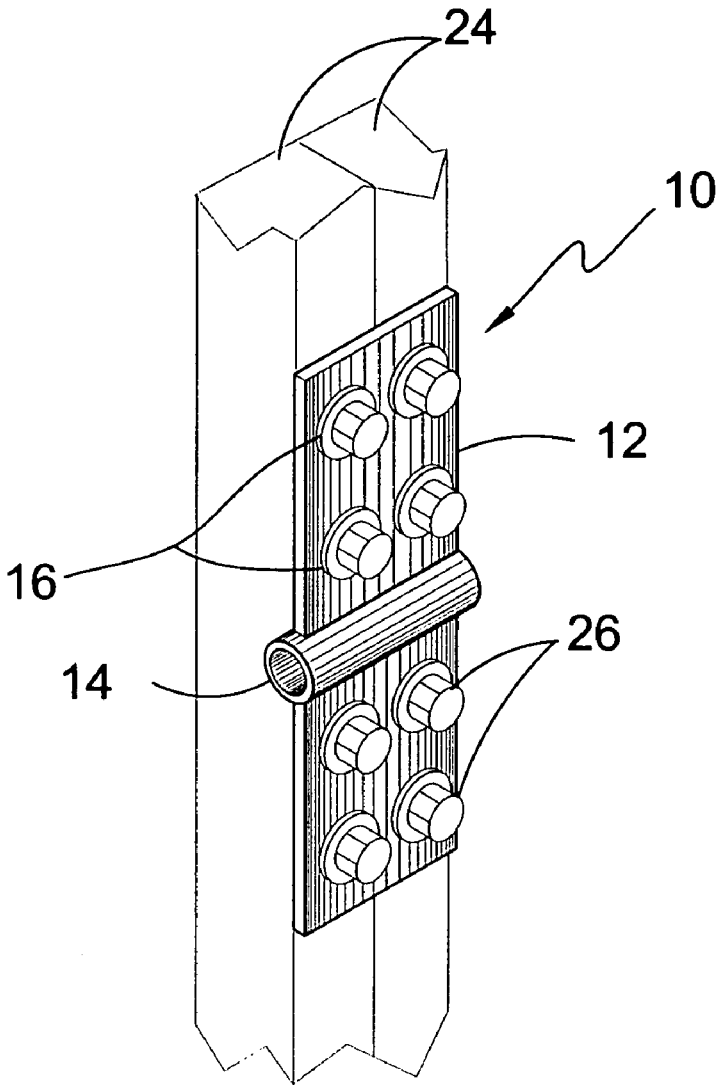
FIG. 3 is a perspective view of the present invention mounted to rough 2×4 lumber.

Turning to FIG. 3, shown therein is a perspective view of the present invention 10 mounted to rough 2×4 lumber 24.

Shown is a perspective view of the present invention 10 being a dead bolt plate which comprises a receiver pipe 14 that is welded to steel plates 12 having mounting apertures 16 therein. The device 10 transfers any force applied to a door's dead bolt to the rough frame, e.g., lumber 24, of the door through the receiver chamber 14 which is bolted with a bolt and washer 26 to the door's rough opening frame.

Figure 4:
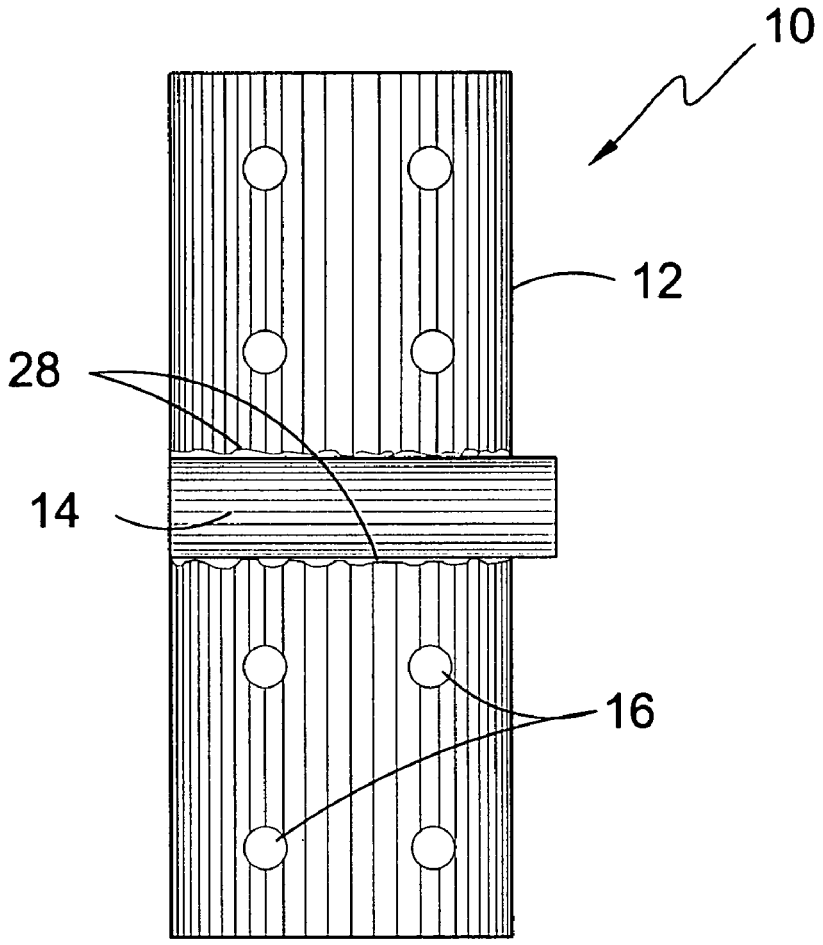
FIG. 4 is a front view of the present invention.

Turning to FIG. 4, shown therein is a front view of the present invention 10. Shown is a front view of the present invention 10 being a dead bolt plate which comprises a receiver pipe 14 that is welded at 28 to steel plates 12 having mounting apertures 16 therein. The device 10 transfers any force applied to a door's dead bolt to the rough frame of the door through the receiver chamber 14 which is bolted to the door's rough opening frame.

Figure 5:
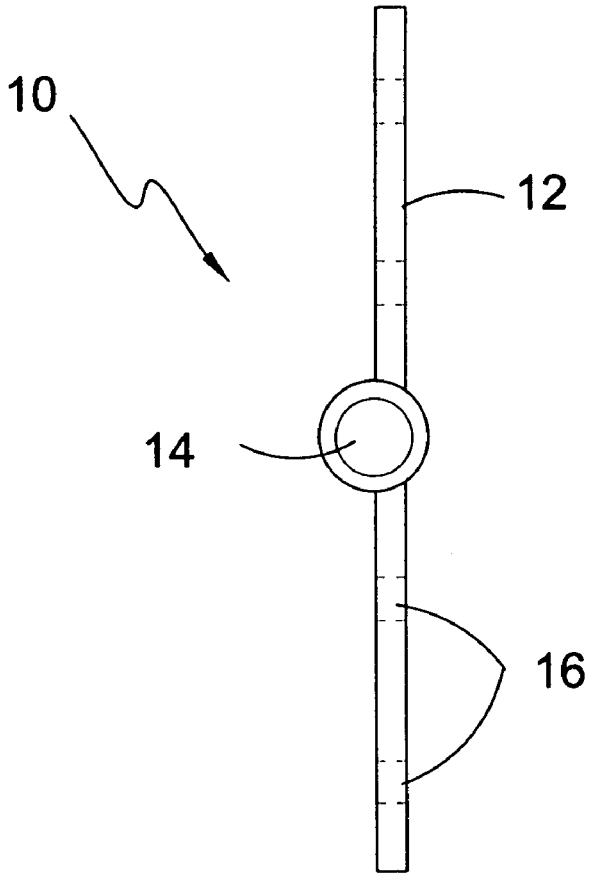
FIG. 5 is a side view of the present invention.

Turning to FIG. 5, shown therein is a side view of the present invention 10. Shown is a side view of the present invention 10 being a dead bolt plate which comprises a receiver pipe 14 that is welded to steel plates 12 having mounting apertures 16 therein. The device 10 transfers any force applied to a door's dead bolt to the rough frame of the door through the receiver chamber 14 which is bolted to the door's rough opening frame.

Figure 6:
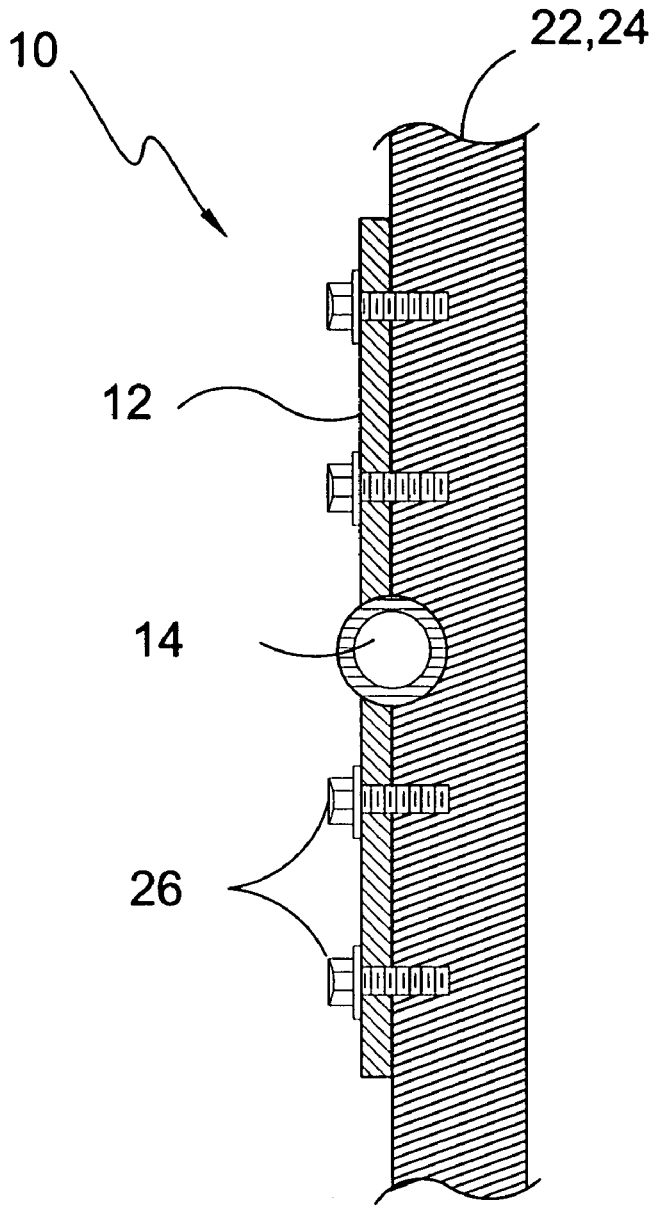
FIG. 6 is a sectional view of the present invention.

Turning to FIG. 6, shown therein is a sectional view of the present invention 10. Shown is a sectional view of the present invention 10 being a dead bolt plate which comprises a receiver pipe 14 that is welded to steel plates 12 having multiple mounting apertures for receiving bolts or fasteners with washers 26 therein. The device 10 transfers any force applied to a door's dead bolt to the rough frame 22, e.g., lumber 24, of the door through the receiver chamber 14 which is bolted to the door's rough opening frame.

I claim:

1. A receiver chamber for receiving an extendable bolt element of a deadbolt lock assembly, the deadbolt assembly being mounted on a door and the receiver chamber being mounted onto a door jamb, comprising:

a) a pair of rigid plates having first and second opposing ends, said plates having a plurality of apertures therein;

b) a receiving chamber, said chamber having first and second opposing ends being open on at least one end, wherein a bore completely surrounded by a wall is disposed therein, wherein wall extends from said first end to said second end; and, c) wherein said first end of each of said plates is welded to said wall of said receiver chamber so that said plates are coplanar, wherein each of said second ends of said plates are disposed opposite each other to permit the plates to be mounted onto the door jamb, so that the bolt can be extended into the bore, the wall of said receiving chamber extending beyond both sides of said plates.

2. The receiver chamber of claim 1, wherein said plates comprise steel.

3. The receiver chamber of claim 2, wherein said receiving chamber comprises steel.

4. The receiver chamber of claim 1, wherein said receiver chamber is cylindrical.

5. The receiver chamber of claim 4, wherein said bore of said receiving chamber is mounted on the door jamb parallel to the bolt element so that the bolt element can be inserted into said bore as the bolt element is extended toward the door jamb to permit the door to be secured to the door jamb.

6. The receiver chamber of claim 4, wherein said receiver chamber is mounted onto a rough frame of the door jamb.

7. The receiver chamber of claim 6, further comprising a plurality of fasteners for mounting the plates directly to the door jamb.

8. The receiver chamber of claim 4, wherein said plates are off center from said receiver chamber wall so that said receiver chamber extends more to one side of said plates than to an opposite side of said plates.

9. The receiver chamber of claim 8, wherein said plates have first and second opposing edges at right angles to a central axis of said receiver chamber and said receiver chamber extends beyond one set of side edges of said plates.

* * * * *